United States Patent [19]

Schuessler

[11] 3,966,137

[45] June 29, 1976

[54] METHOD AND APPARATUS FOR CONTROLLING WEB TENSION

[75] Inventor: Jerome E. Schuessler, Fullerton, Calif.

[73] Assignee: Jeroll Mfg. Co., North Hollywood, Calif.

[22] Filed: Mar. 27, 1975

[21] Appl. No.: 562,562

[52] U.S. Cl. ..... 242/75.43; 242/75.53

[51] Int. Cl.[2] ..... B65H 25/22

[58] Field of Search ..... 242/75.53, 75, 75.43, 242/75.4, 75.2, 75.44, 58.4, 75.5, 58.6, 67.3 R, 75.47

[56] References Cited

UNITED STATES PATENTS

| | | | |
|---|---|---|---|
| 1,640,532 | 8/1927 | Coldwell | 242/75.44 |
| 2,838,253 | 6/1958 | Jacobsen | 242/75.47 |
| 2,902,232 | 9/1959 | Jacobsen | 242/75.47 |
| 3,094,833 | 6/1963 | Breffle | 242/67.3 R |
| 3,112,086 | 11/1963 | Garten | 242/75.53 X |
| 3,160,238 | 12/1964 | Jagenberg | 242/75.43 X |

FOREIGN PATENTS OR APPLICATIONS

| | | | |
|---|---|---|---|
| 396,814 | 8/1933 | United Kingdom | 242/75.44 |

*Primary Examiner*—Edward J. McCarthy
*Attorney, Agent, or Firm*—Poms, Smith, Lande & Glenny

[57] ABSTRACT

A method and apparatus for controlling web tension in a sheet or web of paper stock being removed from a supply roll of paper stock. The method utilizes a relatively low range constant braking pressure on a rotatably mounted roll of paper stock. The method also includes compensating for variations in operating conditions while maintaining such constant uniform braking force on the paper stock roll. An apparatus which includes brake means having a rotor and caliper mounted brake pads engageable with the rotor and actuated by a compressed air-liquid system to maintain constant braking pressure.

11 Claims, 8 Drawing Figures

METHOD AND APPARATUS FOR CONTROLLING WEB TENSION

BACKGROUND OF INVENTION:

In the manufacture of paperboard products such as multi-ply paper and corrugated board for boxes, containers, and the like, it is desired and preferred that the longitudinal tension forces imparted to the paper web be uniform throughout the width of the web. Absence of uniform tension transversely of the paper web creates paper products which may not be acceptable to the trade and which may require additional handling and processing before being acceptable. Non-uniform tension transversely of a paper web may result in warping of the web, that is the forming of a longitudinally curved paper web instead of a web which maintains planar dimensional characteristics.

It will be understood that the paper stock rolls mentioned above may be made of different weights and thicknesses. Such paper roll stock may have a diameter of 60 inches and a width of up to 100 inches. Such paper stock roll may include a core of about 4 inches in diameter. When the paper web is withdrawn from such a paper roll at speeds up to 700 feet per minute, it will be apparent that inertia forces acting on the rotating roll will be continually changing because of the continual reduction in diameter of the roll. Further, to controllably withdraw a paper web from such a paper stock roll without causing over-running, over-turning or free wheeling of the roll requires the application of braking forces on the roll to prevent such over-turning or free wheeling and also to provide control of longitudinal tension in the paper web. With the introduction of automatic systems for controlling the forming and making of paper products, it has become necessary to more precisely control not only the tension in the paper web so that it is uniform throughout the width of the web, but also to assure that a paper stock roll may be braked to a complete stop within a very limited period, such as less than three seconds, in order to splice a paper web from a different stock roll as may be required by the production operation. Further, in the manufacture of corrugated paperboard, non-uniform tension of the paper stock, from which flutes or corrugations are formed, causes flutes of varying height and form which may not be properly bonded to the facing web. Such irregularly fluted paperboard may not withstand required tests and would be unacceptable.

Precise control of tension in a paper web significantly affects the production of paperboard. Lack of proper tension control may result in end to end warp, wrinkling, misalignment of the web, loss of caliper in corrugated board, malformation of flutes or corrugations, undesirable changes in take-up ratio in the production of single face corrugated board, and lack of control of consumption of material in making corrugated board.

Prior proposed systems for controlling the tension in the paper web and braking the paper stock roll at the roll stand have included the use of hydraulically operated drum and brake shoe braking means. A drum and brake shoe brake means was mounted on the ends of roll stand arms which carry and support the paper stock roll. Each pair of brake means was hydraulically operated through a separate master cylinder. To maintain necessary control of tension, the brake setting on each side of the paper roll was set at about 500 psi, approximately 18 psi being required to overcome the brake shoe release spring forces. In operation at such high pressure settings, the brake shoes and the drums as well as the hydraulic fluid became hot because the brake is applied at such 500 psi during the entire operational time for a paper roll. Increase in temperature of the fluid caused further pressure increase because the heated fluid expanded and the master cylinders were preset to a selected pressure. Thus from time to time during operation, an operator was required to check the pressure settings of the master cylinder at each pair of brake means for a paper roll and to readjust the settings. Because of the mechanical features of such a drum type brake system, pressure variations constantly occured with the result that the tension in the paper web continually varied. Under most careful operator control it was extremely difficult to maintain uniform tension across the width of the paper web.

In another proposed braking system, automatic tension control was attempted by employing electronic control units which calculated the required theoretical brake force pressure on the roll in order to maintain constant tension in the web for a specific roll diameter and paper weight. Such a control unit was coupled electrically and pneumatically to a servomechanism unit which regulated the roll stand brake force by changing pressure in the brake line. Such an electrical control unit was utilized with any type of brake system. Since the braking system still included the mechanical characteristics described above, pressures for which the braking means were set were still in a high range in the nature of 1,000 psi.

Other proposed braking systems included tension control means which were responsive to change in weight of the paper stock roll as the roll was depleted.

In all of the prior proposed tension control means known to me, the numerous variable factors affecting the tension of the paper web were attempted to be regulated under conditions in which the brake pressure setting was relatively high, that is in the nature of from 350 to 1,000 psi.

SUMMARY OF INVENTION:

The present invention contemplates a novel method and apparatus for controlling the tension of a paper web by utilizing a braking system in which constant brake setting is within an extremely low pressure range in the nature of from 10 to 50 psi. The capability of utilizing low brake pressure settings reduces the variable factors which so significantly affected the pressure changes in the prior proposed tension control systems. The method of the present invention thus produces significantly lower maintenance and equipment problems in terms of maintenance time, replacement time and in terms of attention of the operator to the brake settings. The present invention contemplates application of a constantly maintained uniform braking force at opposite sides of a paper stock roll and since the braking force is of a relatively low order, the affect of such low braking force in the system results in savings in terms of time, money and wear on equipment. The invention contemplates such precision tension control of a paper web and of the fluted medium of single face corrugated board that the amount of paper consumed or used may be precisely controlled while making properly formed flutes or corrugations. The braking means of this invention is adapted to readily and inexpensively replace prior types of braking units, particularly drum and brake shoe means.

The primary object of the present invention is to disclose a method and an apparatus for precise control of web tension in a paper web whereby the factor of non-uniform web tension is virtually eliminated in a warp control system for paper products.

An object of the present invention is to disclose a braking means for each end of a roll of paper stock which provides uniform equal braking torque at roll ends whereby web tension is virtually uniform transversely of the web.

Another object of the invention is to disclose a brake means for a paper stock roll which requires minimum maintenance and which normally requires no operating adjustment as a full roll is unwound to expired or empty condition.

Still another object of the present invention is to disclose and provide a method for precisely controlling web tension in a paper web drawn from a paper stock roll wherein relatively low pressure forces are applied to the braking system for accomplishing the tension control.

Still another object of the present invention is to disclose a web tension control system which is easy to install, requires minimum maintenance, and which maintains virtually uniform tension in a paper web drawn from paper stock rolls.

A further object of the invention is to disclose and provide a web tension control means which is particularly useful with automatic paper web splicing devices which operate at high speeds and require precise control of the tension, movement, and stopping of a paper web.

The invention contemplates a method and apparatus wherein precise longitudinal tension control is provided and wherein such precise longitudinal tension control may be utilized to control the consumption of paper, particularly in the production of single face fluted paperboard. Precise fine control of longitudinal tension in the fluted medium not only enhances the uniformity of the flute in form and in height, but also provides precise control of the amount of material of the fluted web consumed in relation to that of the mating liner; referred to as take-up ratio. The direct correlation between selected brake pressure and the take-up ratio facilitates control of the consumption of material and thereby may be utilized to effect substantial savings without degrading the paper board product.

A still further object of the present invention is to disclose a braking system for a paper stock roll wherein the braking system utilizes a pressure air-liquid interface to yieldably and resiliently adjust to variations in operation occuring during the production of multi-ply and corrugated paper products. Specifically, the invention contemplates utilizing such an air-liquid interface in which the pressure air is in the order of about 10 to 50 pounds per square inch and is readily available from a plant compressed air source.

Many other advantages and objects of the present invention will be readily apparent from the following description of the drawings in which an exemplary embodiment of the invention is shown.

IN THE DRAWINGS

Figure 1:
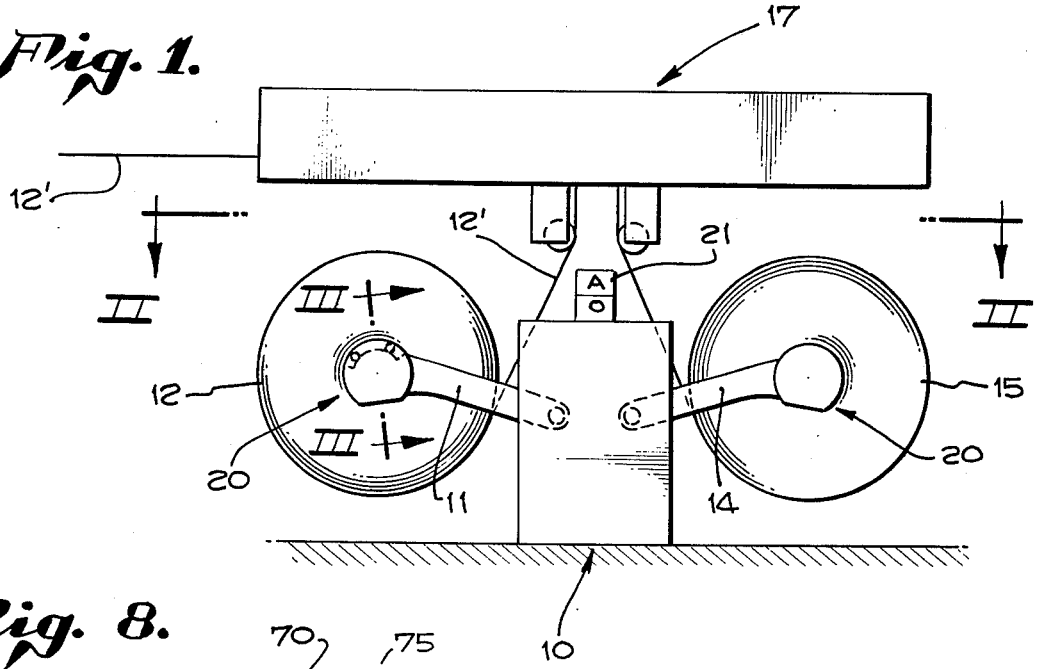
FIG. 1 is a side elevational view of a roll stand equipped with brake means of this invention, the view including a splicer means associated with the roll stand.
Figure 2:
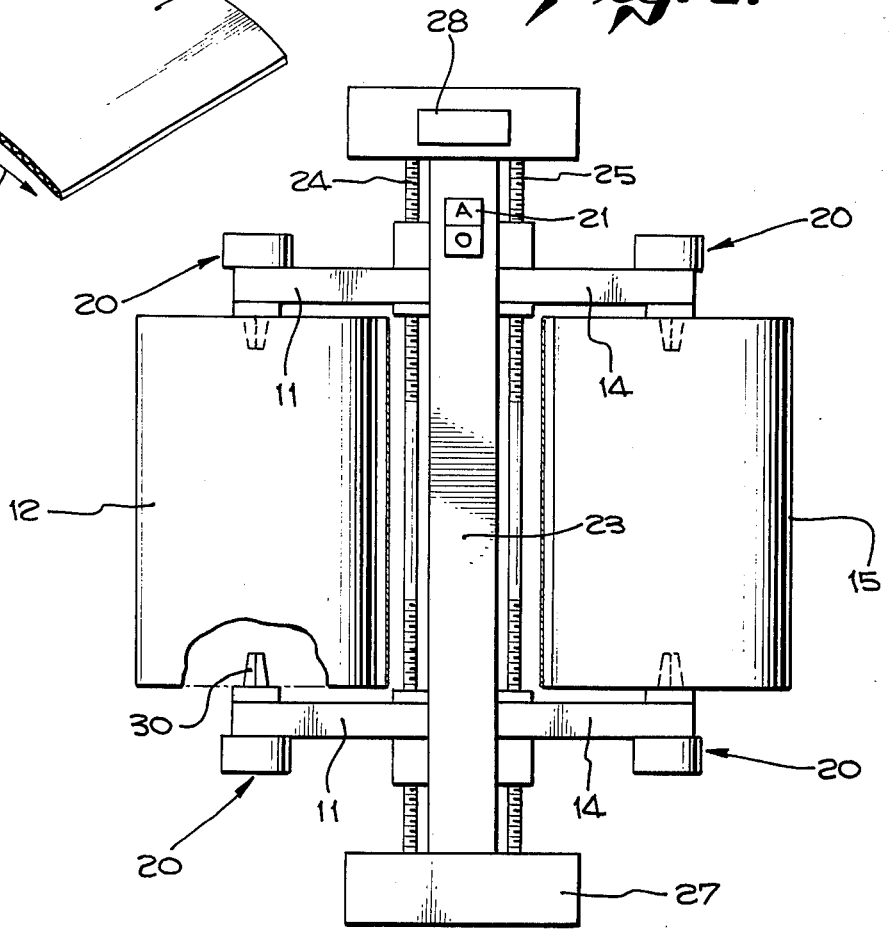
FIG. 2 is a top view taken from the plane indicated by line II—II of FIG. 1.
Figure 3:
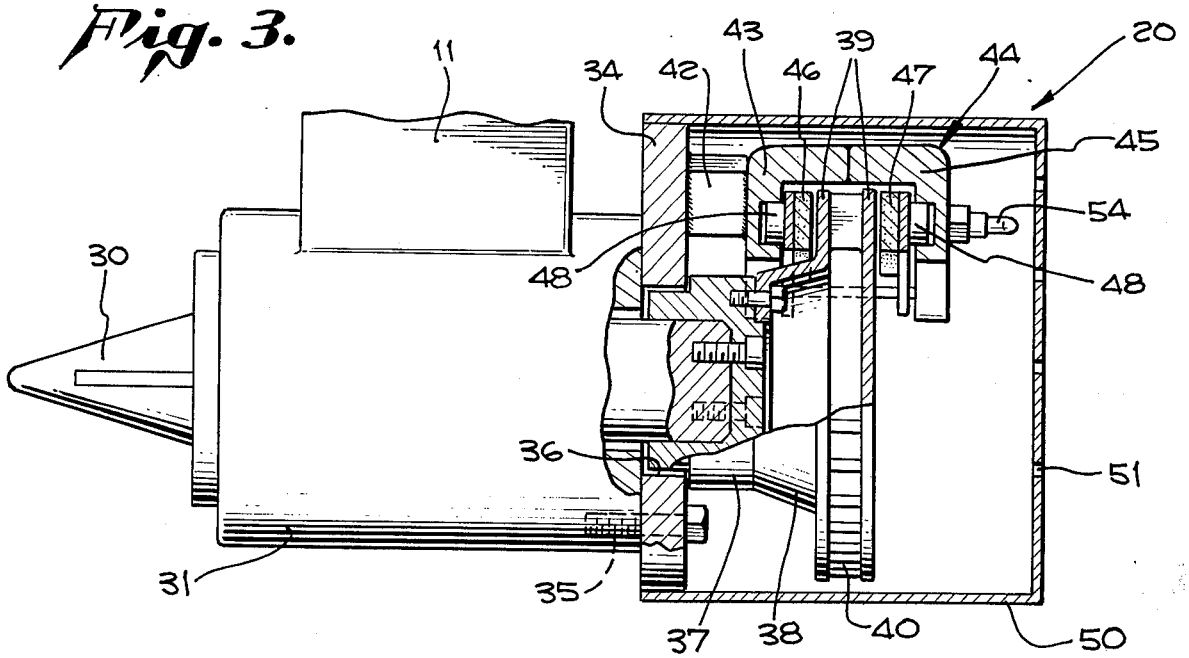
FIG. 3 is a fragmentary sectional view taken in the plane indicated by line III—III of FIG. 1.

In FIGS. 1 and 2, there is shown a roll stand generally indicated at 10 which includes a pair of roll arms 11 for supporting a paper stock roll 12 and another pair of roll arms 14 for supporting a standby or reserve paper stock roll 15. In this illustration, above the roll stand 10 is generally shown a festoon means 17 of a type used to make automatic splices of the paper web while the machine is in operation. At each end of each roll 12 and 15 is provided a brake means 20 embodying this invention, such brake means being supplied with fluid under pressure from an air-liquid or air-oil means 21.

Roll stand 10 may be of well known manufacture, for example, a Langston shaftless mill roll stand, which includes transverse frame means 23 having along sides thereof, screw shafts 24 and 25 operably connected with pair of roll arms 11 and 14 respectively for moving said pairs of roll arms inboardly and outboardly in order to engage and disengage paper stock rolls 12 and 15. Elevating means are provided at the inner ends of each pair of arms 11 and 14 for elevating and lowering the pairs of arms.

At one end of roll stand frame means 23 may be provided drive means 27 and at the opposite end of frame means 23 may be provided a means 28 having pneumatic or other type controls for operation of the roll stand arms 11 and 14.

Festoon means 17 may also be of well known manufacture and is generally indicated. Festoon means 17 provides a storage means for paper web from roll 12, the festoon means 17 receiving web 12' and forming an expandable and contractable paper web storage and slack system which discharges paper web 12' at one end of festoon means 17. Festoon means 17 serves to store sufficient lengths of paper web 12' to permit splicing of standby paper roll 15 thereto in well known manner and under operating conditions where paper web 12' is being supplied at up to seven hundred feet per minute. Festoon means 17 is employed with automatic equipment not shown or described and capable of completing a splice between paper roll 12 and 15 in three seconds or less.

Means for engaging and disengaging a paper stock roll 12 and 15 is provided at free ends of roll arms 11 and 14 and may comprise a stub shaft 30 rotatably mounted in bearing housing 31. Shaft 30 is adapted to engage and interlock with one end of the core (not shown) of a paper stock roll. The core of the paper roll is well known and mates or couples with the stub shaft 30 to provide antifriction rotatable mounting of paper stock rolls.

Brake means 20 may comprise a base or backing plate 34 attachable to the outboard face of the bearing housing 31 by suitable cap screws 35. Base 34 has an opening 36 coaxial with the bearing housing 31, opening 36 receiving a rotor hub member 37 attachable to the outboard end of shaft 30 for rotation therewith. Hub member 37 carries a disc type rotor 38 provided with inboard and outboard spaced annular discs 39. Cooling air passages 40 are provided between discs 39. Rotor 38 is thus mounted for rotation with the stub shaft 30 in the bearing housing 31 and rotates with a paper stock roll 12, 15 when the roll is mounted on the roll stand.

Brake means 20 also includes a pair of mounting blocks 42 in approximately 90 degree spaced relation on the base plate 34, said mounting blocks 42 serving to mount the inboard caliper part 43 of a caliper assembly generally indicated at 44. Caliper assembly 44 includes an outboard caliper part 45. Supported between the caliper parts 43 and 45 are inboard and outboard disc brake pads 46 and 47 for engagement with rotor 38. Each caliper part 43, 45 includes a pair of piston means 48 for application of pressure to the brake pads 46, 47 for frictionally engaging rotor 38 under selected pressure. The caliper assembly and rotor may be of known manufacture, and includes four pistons of approximately 1½ inches in diameter, each providing braking forces of selected foot pounds of torque under relatively low brake fluid pressures.

A suitable housing 50 provided with vents 51 may enclose the base and disc brake assembly.

Figure 4:
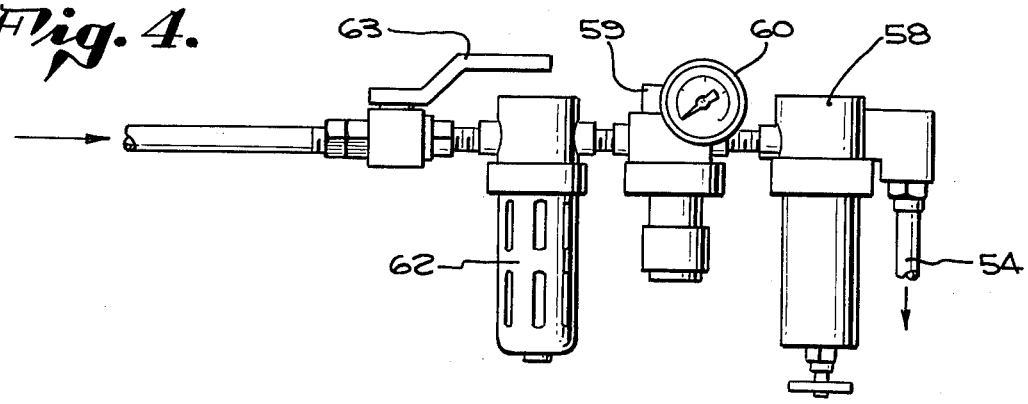
FIG. 4 is a fragmentary view of the air-liquid system used in this invention.
Figure 5:
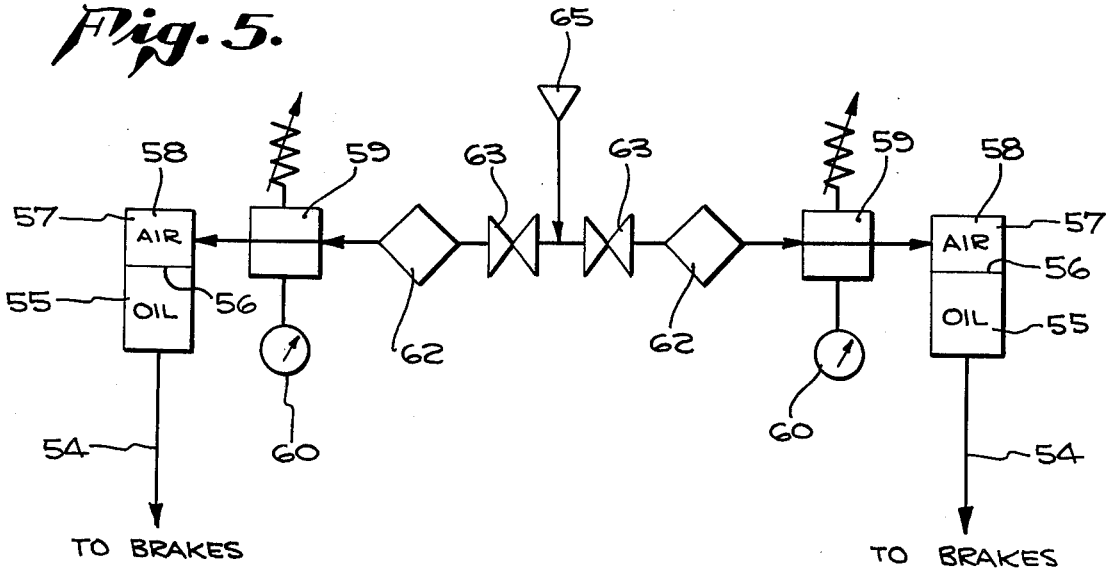
FIG. 5 is a schematic diagram of the air-liquid system used with the brake means shown above.

Each pair of brake means 20 mounted on roll stand arms 11 and 14 may be supplied fluid under pressure through an air-liquid system generally indicated in FIGS. 4 and 5. Each brake means 20 includes a connection to a brake fluid hose 54 which carries a suitable non-compressable liquid such as oil or well-known brake fluid. Brake hose 54 communicates with a reservoir means 55 containing a supply of brake liquid. The liquid in the reservoir 55 has a top surface 56 which interfaces with compressed air 57 in the upper part of the reservoir means 55. In the exemplary low pressure system being described, the pressure air 57 may interface with the surface of the liquid in direct manner. In the event the system is to operate under relatively high pressures, as for automatic splicing, suitable self-regulating fluid operated piston means may be used.

Pressure air in chamber 58 may be connected to a suitable pressure regulator 59 for setting and maintaining a desired air pressure in chamber 58. Pressure regulator 59 includes a dial indicator 60 showing the amount of air pressure in air chamber 58.

Pressure regulator 59 is connected to a suitable air filter 62 which receives pressure air through an on and off valve 63 which may be connected to a plant supply at 65 of compressed air at about 100 psi.

In normal operation, that is without automatic high speed splicing of paper rolls, the amount of pressure at which the brake means are set is determined by assuring that paper roll 12 will not free wheel nor produce flapping of the paper web as the paper roll is being unwound at a selected speed. The selected pressure setting to accomplish this result is of course dependent upon the diameter and width of the roll and the weight of the paper stock. For example, a paper stock roll may weigh 6,000 pounds.

Brake means 20 provides increased piston areas acting against each brake pad since each caliper part includes a dual piston as above described. Braking forces in terms of foot pounds of torque applied through the disc braking pads to the rotor are substantially equal. Thus the factors of increased piston areas and equal braking pressure permits the use of a relatively low pressure range for such brake settings for a paper stock roll as described above. In most instances, in normal operation (not automatic splicing) a brake setting would not exceed 30 psi for operations in which the paper web was moved at a rate of up to 700 feet per minute. Uniform braking pressure on opposite sides of a roll operating at such low pressure ranges minimizes the effect of tension forces which may develop in the paper web because of changing from full roll to expired roll condition. The tension forces developed are of such a low order that they do not significantly affect the warp of the web. The air oil fluid braking system provides sufficient resiliency and yieldability in the braking fluid system such that any heating of the liquid in the braking system which might tend to expand and increase braking pressure is compensated by a self-relieving regulator 59 in the air-oil fluid system. Operation of the braking means 20 at low pressure ranges with large piston areas gives more uniform distribution of force on friction surfaces of brake pads and substantially eliminates mechanical problems which were part of the drum type braking system. The provision of substantially equal braking forces at opposite ends of the roll also tends to equalize whatever tension forces which might be developed in the paper web while the web is being unwound from the roll.

The capability of operating at such low brake pressure settings contrasts with the relatively extremely high brake pressure settings required by prior proposed brake means. As a result of the high brake pressure settings in prior proposed brake means, increase in tension as the paper web is withdrawn from the paper stock roll requires adjustment by the operator. To permit such adjustment, the brake pressure settings must be set high enough so that when tension in the web becomes unequal the operator will have sufficient braking pressure to maintain necessary web tension to prevent free wheeling.

Figure 6:
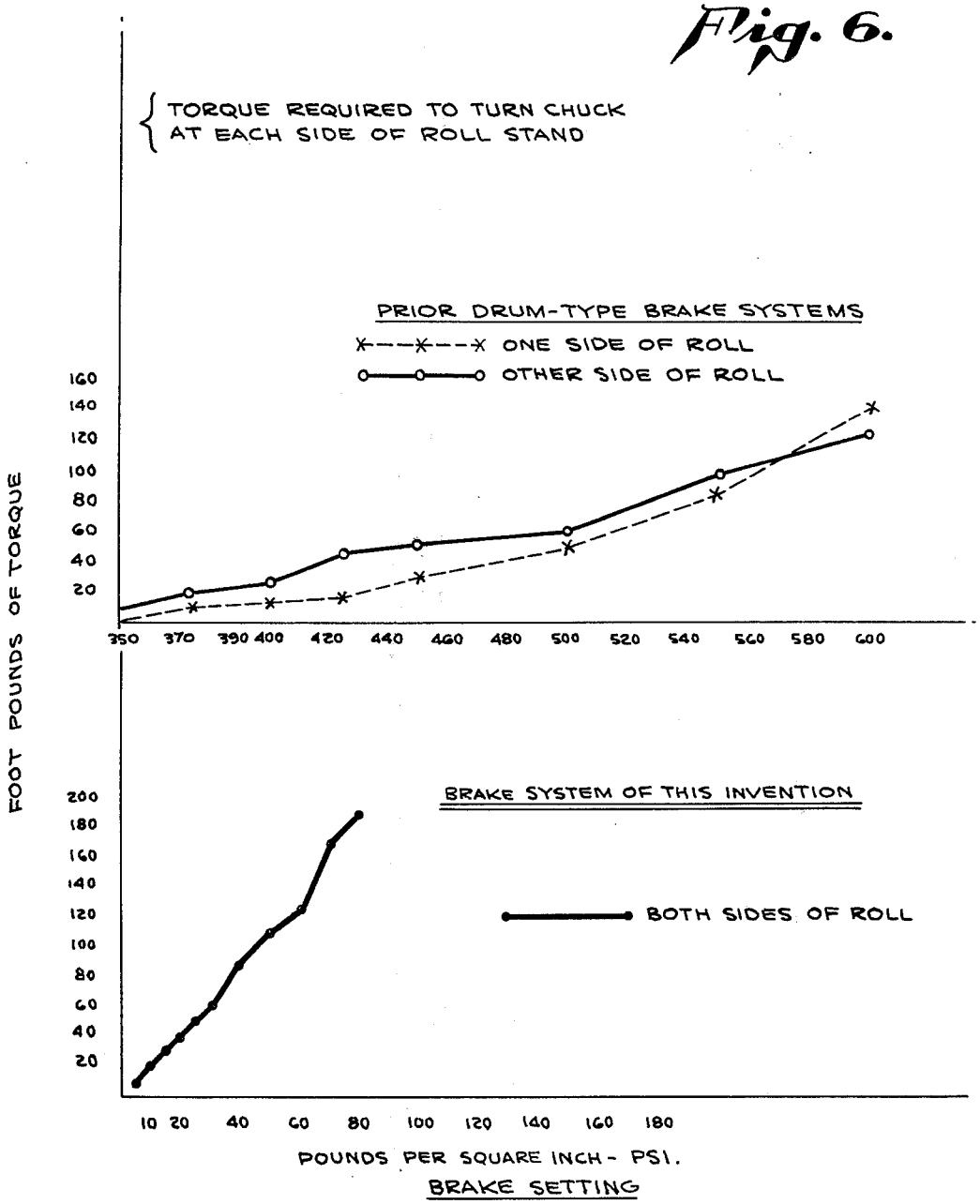
FIG. 6 is a chart showing brake setting related to foot pounds of torque at a roll stand equipped with prior drum type brakes and at a roll stand equipped with the brake means of this invention.

This contrast between prior proposed brake means and the brake means 20 of this invention is clearly indicated in FIG. 6 which shows the changes in foot pounds of torque at opposite ends or each side of a paper stock roll under pressures indicated. The chart shows foot pounds of torque and brake settings in terms of pounds per square inch of hydraulic pressure, the lower portion of the chart showing psi from 15 to 80, and the upper part of the chart showing brake settings of psi from 350 to 600 representing a typical drum type brake means employed on a roll. In the upper part of FIG. 6 in which the brake setting occurs at a range of between 350 to 600 psi, the solid line drawn represents the foot pounds of torque required to turn one coupling member at one side of a roll under pressures indicated. The dash line with X marks shows the foot pounds of torque required on the chuck engaged with the other side of the roll. It will be readily apparent from a study of the two curves shown in the upper part of FIG. 6 that the braking force is non-uniform and permits differences in tension in the web which actually change in magnitude from one side to the other at brake setting pressures between 550 and 600 psi.

In the lower part of the chart shown in FIG. 6 is illustrated the foot pounds of torque imposed on a brake means similar to that described as brake means 20. It will first be noticed that only a single line is shown and that this line represents the foot pounds of torque on both sides of the roll. Coincidence of the lines plotted from data gathered at opposite ends of a roll indicates that the brake pressure is uniform. The lower part of the chart also indicates that the number of foot pounds of torque available at the brake means 20 is achieved at a very low pressure range of almost 10 times less than that employed by a drum type brake. The capability of using low pressure ranges and substantially equal braking forces on opposite sides of a roll results in highly efficient tension control of the web as a result of the braking means employed.

In an automatic operation where splicing of one paper roll to another paper roll is accomplished at high speeds it may be desirable to impose on the brake fluid system described above pressures which exceed 30 to 50 psi and which may be increased sufficiently to exert foot pounds of torque on each side of a roll in the order of 4 to 5 hundred foot pounds. Such situation occurs when it is desired to stop for example rotation of a 6,000 pound roll from which paper web is being withdrawn at 700 feet per minute in 1½ seconds. Brake means 20 are particularly useful in such applications because the brake pressures and the amount of foot pounds of torque applied at each end of a paper roll 12 are substantially equal. Rapid stopping of rotation of such a paper roll with equal braking pressure applied at opposite ends of the roll avoids the imposition of tension forces on the paper web which might be great enough to sever the paper web.

Figure 8:
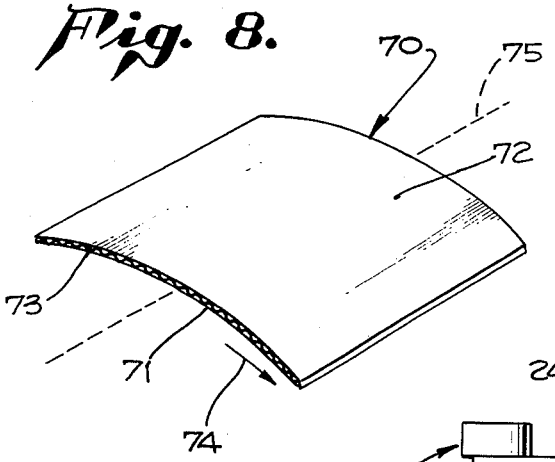
FIG. 8 is a perspective view of paperboard showing end to end warp caused by non-uniform longitudinal web tension.

The advantages of precise control of tension of both the fluted or corrugated medium and of the liner will be readily understood by those skilled in the art. In FIG. 8 is a perspective view of a section of corrugated paperboard generally indicated at 70 in which there is provided a bottom liner 71, a top liner 72 and a fluted medium 73. The direction of movement of the liner 71 and fluted medium 73 through the machine is indicated by arrow 74. The curvature of the end to end warp shown in FIG. 8 is indicated as being about axis 75. Non-uniform tension of liners 73 and 72 as well as the fluted medium 73 will produce such end to end warp.

Figure 7:
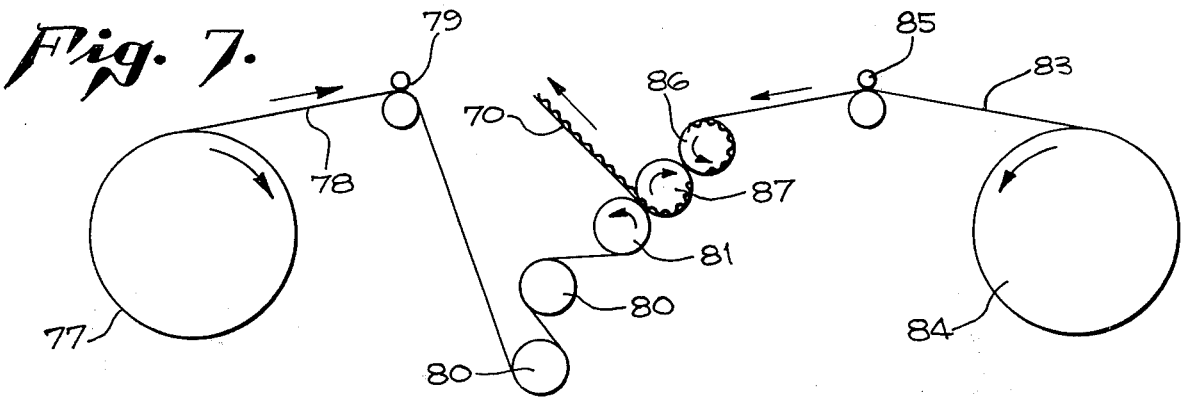
FIG. 7 is a schematic view of a machine for making single face corrugated paperboard.

In FIG. 7 is schematically illustrated a machine for making single face corrugated board in which a paper stock roll 77 provides a paper liner 78 which passes through a liner counter 79 and thence over a pair of heater rolls 80 to pressure roll 81 where it is joined with medium 83. Medium 83 is unwound from a paper stock roll 84 and passes through a medium counter 85 and thence between upper and lower corrugating rolls 86, 87 which rotate in opposite directions and which deform the medium 83 into a selected number of corrugations per lineal foot and of preselected height and formation. As the formed corrugated medium leaves the lower corrugation roll, it is joined with the liner 78 to provide a single face corrugated board.

It will be apparent that precise control of tension in the liner 78 and in the medium 83 will provide the advantages described above with respect to control of warp. In addition, take-up ratio, that is the amount of medium 83 compared to the amount of liner 78 used in the single face corrugated board 70 it is readily determined by the counters 79 and 85. It will be apparent that the take-up ratio will be determined to some extent by the control of the braking pressure on the rolls 77 and 84 and that as the braking pressures on the medium roll stand increases tension in the medium 83, the take-up ratio will be lowered. Too much tension will have a detrimental effect on the production of the corrugated medium, however, precise control of the braking pressures and tension on the medium will permit the use of a minimum take-up ratio while providing acceptable flute contour design. By utilizing the precision tension control means of this invention the take-up ratio may be lowered without affecting the quality of the product, and at the same time providing a control of the consumption of the medium roll 84 so that a substantial savings in the material of the medium 83 is achieved while maintaining the required standards for the corrugated paperboard. The brake means of the present invention with its maintenance of constant low braking pressure on the paper stock rolls and the precise control of tension forces uniformly imparted to the paper web provides a means for control of the consumption of the paper web.

It will be apparent from the above description that the web tension control means of this invention provides operation at such relatively low constant braking pressure maintained by the air-liquid self relieving regulator system that the amount of tension forces that might possibly be imparted to the paper web are of an order which is sufficient to create warp in the paper product. Such elimination of end to end warp caused by non-uniform tension, and the reduction of not only the amount of tension forces which might come into play in the paper web but also the virtual elimination of non-uniform tension across the web, achieves the many advantages described above. Overheating of the braking system and resultant non-uniform changes in braking forces is avoided and eliminated.

Various modifications and changes in the method and apparatus of this invention may be made within the spirit of this invention and all such changes and modifications coming within the scope of the claims are embraced thereby.

I claim:

1. In a method reducing to a minimum one of the factors causing warp in paperboard, said one factor being non-uniform longitudinal tension across the width of a paper web as the web is withdrawn from a paper stock roll, the steps of:

applying a uniform constant braking pressure to opposite ends of a paper stock roll as the roll is unwound;

limiting the brake setting pressure to a preselected low pressure between 10 to 80 pounds per square inch;

and maintaining said braking pressure at a uniform constant low pressure whereby control of longitudinal tension forces on said paper web is maximized.

2. In a method as stated in claim 1 including the step of selecting a braking pressure which provides between 10 to 190 foot pounds of torque at each end of the paper stock roll.

3. In a method as stated in claim 1, said paper web being joined with a fluted paper medium, the amount of paper medium fluted for each unit amount of web consumed being expressed as take-up ratio, including the steps of:

adjusting the braking pressure selected to obtain optimum consumption of paper with reference to take-up ratio between said fluid paper medium and another paper web with which it is joined.

4. A tension control means for a roll stand having a pair of roll stand arms with shaft means for rotatably mounting a roll of paper stock having a core engaged by said shaft means comprising:

brake means on said shaft means for maintaining uniform selected braking pressure at opposite ends of the paper roll;

each brake means including a rotor connected to said shaft means and caliper means including dual pistons and brake pads on each side of the rotor;

and means for actuating said brake means including an air-liquid pressure fluid system having a reservoir with a liquid portion in communication with said caliper means and a pressure air portion above said liquid portion in communication with a compressed air source;

and self-regulating means for said pressure air whereby said air reservoir portion is maintained at a constant preselected pressure to prevent free wheeling of the paper roll under varying tension conditions between full and expired roll conditions.

5. A means as stated in claim 4 wherein said selected braking pressure is in a low range of 10 to 50 psi.

6. In an apparatus for making corrugated board in which a paper liner is joined with a fluted paper medium, the paper liner and medium being drawn from separate paper stock rolls, the amount of paper medium fluted for each unit amount of unfluted liner consumed being expressed as take-up ratio, the provision of:

means for precisely controlling tension in at least said paper roll supplying the fluted medium for controlling consumption thereof at an optimum take-up ratio;

said means comprising disc brake means at opposite ends of the medium paper roll operable at selected braking pressure ranges, said brake means including means for maintaining a constant uniform braking pressure on opposite sides of the medium paper roll, said latter means including a self-regulating fluid brake system.

7. A tension control means for a roll stand having a pair of roll stand arms with shaft means for rotatably mounting a roll of paper stock having a core engaged by said shaft means comprising:

brake means on said shaft means for maintaining uniform selected braking pressure at opposite ends of the paper roll;

each brake means including a rotor connected to said shaft means and caliper means including piston means and brake pad means to apply a braking force to said rotor;

means for actuating said brake means including a pressure fluid system in communication with a compressed air source;

and self-regulating means for said pressure air whereby said pressure air is maintained at a constant preselected pressure to prevent free wheeling of the paper roll under varying tension conditions between full and expired roll conditions.

8. A tension control means for a roll stand on which a paper stock roll of sheet material is rotatably mounted on a shaft means supported on roll stand arms, comprising in combination:

disc brake means at opposite ends of said stock roll, each brake means including a rotor disc on said shaft means and brake pad means carried by said roll stand arms, and fluid pressure means for urging said brake pad means against said rotor disc, and means including pressure air for maintaining said fluid pressure means at each brake means at a uniform constant preselected braking pressure whereby longitudinal tension forces on said sheet material are uniform across said sheet thereby minimizing warp in said sheet.

9. In a tension control means as stated in claim 8 wherein said means for maintaining said pressure fluid means at a uniform constant preselected braking pressure includes a self-regulating fluid brake system.

10. In a tension control means as stated in claim 9 wherein said self-regulating fluid system includes an air liquid pressure fluid system having an air reservoir portion maintained at constant preselected pressure.

11. In an apparatus for making corrugated board in which a paper liner is joined with a fluted paper medium, the paper liner and medium being drawn from separate paper stock rolls, the amount of paper medium fluted for each unit amount of unfluted paper liner consumed being expressed as take-up ratio, the provision of:

a tension control means for each paper stock roll for precisely controlling longitudinal tension in each of said paper medium and unfluted paper liner being withdrawn from respective rolls and for controlling the amount of paper from said paper stock roll forming fluted paper medium as related to the amount of paper being drawn from said paper stock roll providing said unfluted paper liner, such take-up ratio being optimized by control of tension at at least the stock roll providing the paper medium to be fluted;

said tension control means including disc brake means at opposite ends of each of said stock rolls, each of said brake means including a rotor disc and brake pad means, and fluid pressure means for urging said brake pad means against said rotor discs;

and means for maintaining said fluid pressure means at a uniform constant preselected braking pressure for each of said paper stock rolls whereby optimum consumption of the fluted paper medium and the unfluted paper liner joined thereto is provided.

* * * * *